US008190417B2

(12) United States Patent
Shachar et al.

(10) Patent No.: US 8,190,417 B2
(45) Date of Patent: May 29, 2012

(54) REAL TIME SIMULATING METHOD AND SYSTEM USING A SEQUENCE DIAGRAM

(75) Inventors: Yosef Shachar, Moshav Bet She'arim (IL); Dotan Tsadok, Afula (IL); Michal Gal, Ramat Begin (IL); Idan Adi, Kfar Vradim (IL); Ori Kovetz, Atzmon (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 775 days.

(21) Appl. No.: 12/278,734

(22) PCT Filed: Feb. 8, 2007

(86) PCT No.: PCT/IL2007/000178

§ 371 (c)(1),
(2), (4) Date: Jan. 16, 2009

(87) PCT Pub. No.: WO2007/093985

PCT Pub. Date: Aug. 23, 2007

(65) Prior Publication Data

US 2009/0292518 A1 Nov. 26, 2009

(30) Foreign Application Priority Data

Feb. 13, 2006 (IL) ..... 173711

(51) Int. Cl.
*G06F 17/50* (2006.01)
*G06F 9/45* (2006.01)

(52) U.S. Cl. ..... 703/13; 703/22

(58) Field of Classification Search ..... 703/13, 703/22

See application file for complete search history.

(56) References Cited

U.S. PATENT DOCUMENTS 5,228,854 A * 7/1993 Eldridge ..... 434/11
5,591,031 A * 1/1997 Monk et al. ..... 434/14

(Continued)

FOREIGN PATENT DOCUMENTS

GB 2 213 616 A 8/1989

(Continued)

OTHER PUBLICATIONS

Kenney et al., "Using Abstration to Isolate Hardware in an Object-Oriented Simulation", American Institute of Aeronautics and Astronautics, 1998, p. 1-9.

(Continued)

*Primary Examiner* — Dwin M Craig
*Assistant Examiner* — Aniss Chad
(74) *Attorney, Agent, or Firm* — Merchant & Gould P.C.

(57) ABSTRACT

System for simulating sub-systems of a tested system includes: (a) a sequence diagram storage defining the inter-communication of messages between various sub-systems of a real system; (b) an indicator for the sequence diagram those missing sub-systems, which have to be simulated; (c) a receiver within the sequence diagram for receiving activation signal for the sequence diagram, and for maintaining only those messages relating to missing sub-systems. The system also includes (d) one or more simulated sub-system units, each containing a domain of predefined output and input messages; and (e) a real time engine for activating said sequence diagram, receiving messages relating to missing sub-systems from the simulated sub-systems units, introducing in real time the received messages on a bus leading to the real sub-systems, and receiving messages issued by the real sub-systems and conveying them in real time to the simulated sub-system units.

13 Claims, 5 Drawing Sheets

U.S. PATENT DOCUMENTS

| | | | | |
|---|---|---|---|---|
| 6,283,756 | B1 * | 9/2001 | Danckwerth et al. | 434/11 |
| 6,389,079 | B2 * | 5/2002 | Raheli et al. | 375/262 |
| 6,505,342 | B1 | 1/2003 | Hartmann et al. | |
| 6,629,085 | B1 * | 9/2003 | Krogmann | 706/2 |
| 7,092,867 | B2 * | 8/2006 | Huang et al. | 703/21 |
| 7,228,261 | B2 * | 6/2007 | Leonard et al. | 703/8 |
| 2002/0052725 | A1 | 5/2002 | Wasynczuk et al. | |
| 2002/0111783 | A1 * | 8/2002 | Kodosky et al. | 703/13 |
| 2005/0160395 | A1 | 7/2005 | Hughes | |
| 2005/0256692 | A1 | 11/2005 | Monin et al. | |
| 2006/0080077 | A1 * | 4/2006 | Johnson et al. | 703/22 |
| 2006/0183083 | A1 * | 8/2006 | Moran et al. | 434/11 |

FOREIGN PATENT DOCUMENTS

| | | | |
|---|---|---|---|
| GB | 2 400 692 | A | 10/2004 |
| WO | 2005/091177 | A2 | 9/2005 |
| WO | 2005/121915 | A1 | 12/2005 |

OTHER PUBLICATIONS

Waeltermann et al, "Hardware-in-the-Loop Testing in Racing Applications", SAE Motor Sports Engineering Conference & Exhibition, Nov. 30-Dec. 2, 2004, Dearborn, No. 2004-01-3502.

James et al., "Integrated Vehicle Test Bed for IVHM Systems on 2nd Generation RLV", 0-7803-7231-X/01, Mar. 9, 2003 IEEE.

Lane et al., "Interoperability and Synchronisation of Distributed Hardware-in-the-Loop Simulation for Underwater Robot Development: Issues & Experiments", Proceedings of the 2001 IEEE International Conference on Robotics & Automation Seoul, Korea, May 21-26, 2001, p. 909-914.

Innocenti et al., "A Synthetic Environment for Simulation and Visualization of Dynamic Systems", Proceedings of the American Control Conference, San Diego, California, Jun. 1999, p. 1769-1773.

Gaskell et al., "Synthetic Environments for Simulated Missions", 2001, IEEE, p. 7-3549-7-3556.

Mobley et al., "Use of Hardware-in-the-Loop Simulation (HWIL) in the Development, Test, and Evaluation of Multi-Spectral Missile Systems", American Institute of Aeronautics and Astronautics, Paper # AiAA-99-40, 1998.

Buxton et al., "Interoperability Testing Using the Hardware-in-the-Loop Test Tool", TRW, Schriever AFB, Colorado Springs, CO, Jun. 24, 1999.

Jackson et al., "An Overview of Hardware-in-the-Loop Simulations for Missiles", 1997 AIAA GNC, AFM, and MST Cofnerence and Exhibit, Aug. 11-13, 1997, pp. 1-7, New Orleans, LA.

Peter H. Zipfel, "Modeling and Simulation of Aerospace Vehicle Dynamics", 2nd Edition, AIAA Education, 2001, pp. 487-498, 500, 504-511.

Marchand et al., "A Plug and Play Joint Test Environment for Future Operational Testing", Joint Advanced Distribued Simulation Joint Test Force, Albuquerque, NM, 1999.

Torngren, "Real-time Control and Programming—the RIP Course", Proceedings of the 2005 Asia and South Pacific Design Automation Conference, Dec. 6, 2005.

Brisolara et al., "Comparing High-Level Modeling Approaches for Embedded System Design", 2005.

UML Basics: The Sequence diagram, at www.ibm.com, 2004.

"Agile Modeling—Effective Practices for Extreme Programming and the Unified Process", www.ambysoft.com., John Wiley & Sons, ISBN#:0471202827, Mar. 21, 2002.

"The Elements of UML 2.0 Style", Cambridge University Press, 2005, ISBN#: 0-521-61678-6, www.ambysoft.com, May, 9, 2005.

Mrozek Z., "Computer Aided Design of Mechatronic Systems"., Int. J. Appl. Math. Comput. Sci., 2003, vol. 13, No. 2, 255-267.

Mrozek Z., "UML as Intergration Tool for Design of the Mechatronic System", Second Workshop on robot Motion and Control, Oct. 18-20, 2001, Bukowy Dworek, Poland, p. 189-194.

Cramp A., "Simulating Multiple Systems of Systems Using the High Level Architecture", A Dissertation Submitted to the Department of Computer Science of the University of Adelaide for the Degree of Doctor of Philosophy, Nov. 2005, p. 1-158.

Sjogren E., "Hybrid UML-based State Machines in Open ebXML"., Master's Thesis in Computer Science at the School of Engineering Physics, Royal Institute of Technology, Feb. 24, 2003.

Hooman et al., "Validating UML Models of Embedded Systems by Coupling Tools", Embedded Systems Institute, Eindhoven & University of Nijmegen, the Netherlands, 2004, p. 1-17.

Hooman et al., "Coupling Simulink and UML Models", Embedded Systems Institute & University of NijmegenHooman et al., 2004.

Vanderperren et al., "SysML and Systems Engineering Applied to UML-Based SoC Design", Proc. 2nd UML-SoC Workshop at 42nd DAC, Anaheim (CA), USA, 2005.

KeungSik et al., "UML-Based Modeling and Simulation Method for Mission-Critical Real-Time Embedded System Development", Proceedings of the 24th IASTED International Multi-Conference, pp. 160-165, Feb. 14-16, 2006, Innsbruck, Austria.

* cited by examiner

REAL TIME SIMULATING METHOD AND SYSTEM USING A SEQUENCE DIAGRAM

This application is a National Stage Application of PCT/IL2007/000178, filed 8 Feb. 2007, which claims benefit of Serial No. 173711, filed 13 Feb. 2006 in Israel and which applications are incorporated herein by reference and a claim of priority is made.

FIELD OF THE INVENTION

The field of the invention generally relates to a method for simulating in real time, a system which comprises a plurality of sub-systems, that perform intercommunication one with the others.

BACKGROUND OF THE INVENTION

The process of developing a system which comprises plurality of sub-systems is generally very long and complicated. Several separate groups are generally assigned for separately developing each sub-system, while defining at least the following for each sub-system:

a. An input messages domain which includes all the possible input messages that the sub-system may receive, and one or more other sub-systems that can issue each of said input messages;
b. The input vs. output behavior of the sub system (i.e., the product of the sub-system); and
c. An output messages domain that includes all the messages that the sub-system can issue, and the addressee for each of said output messages.

During the very long process of the real system development, or more particularly, of each and all the separate real sub-systems involved, there are many occasions in which a need is arisen to test the inter-behavior of two or more sub-systems, one with respect to the others. However, naturally the development of all the separate real sub-systems does not progress at the same speed, and there are many cases in which one sub-system cannot be tested until the development of another sub-system sufficiently progresses to a desired stage. Such scenarios cause many undesired delays in the system development. Moreover, even when the development of the whole system is close to the final stage, and all the sub-systems are supposed to be available for a complete system test, there are cases in which one sub-system is missing due to a sudden failure, causing the complete test to be postponed until the missing sub-system is provided.

It is therefore desired to provide a simulating system which can replace, at any time, one or more sub-systems of a real system, or alternatively, when any simulated sub-system becomes available, to easily substitute the real sub-system for the simulated one.

An example of such a system is a missile system. The missile system comprises the missile sub-system itself (which has tracking and guiding capabilities, etc.), the launcher sub-system, the control center sub-system, etc. In this case, it is sometimes necessary to carry out a partial test of the real sub-systems. For example, in order to test a real control center and a real launcher which are available, without having a missile, there is a need to substitute a real missile with a simulated missile. In another example, there may be occasions in which the launcher and the missile are unavailable while testing of the control center is necessary. In that case the simulator has to simulate both the launcher sub-system and the missile sub-system. Later, when one of said sub-systems becomes available, the simulation for this sub-system may be replaced by the real sub-system, which has just recently become available. It should be noted that it is necessary to introduce to each sub-system, either real or simulated, an external and real-time "world" as similar as possible to the real world, with as many various events and failures, as possible. For example, when testing a missile on the ground, it is necessary to provide a flight-like simulation.

Sequence diagrams are widely used in the art by engineers who define the intercommunication between the various sub-systems of a developed system. A sequence diagram describes sequentially, in terms of time, the messages that flow in the system between the various subsystems. Moreover, the issuing of at least some of the messages in the sequence diagram is conditioned, and said conditions are part of the sequence diagram. In general, the sequence diagrams are graphically described. It should be noted that each sequence diagram may comprise several sub-sequences. Sequence diagrams are well known in the art, and they can be prepared using the language UML (versions 1 and 2 are presently available).

It is therefore an object of the present invention to provide a method and tool for forming a real time simulator which is capable of simulating, either partially or completely, a real system which in turn, comprises plurality of sub-systems.

It is another object of the present invention to provide generic method and tool for designing simulators for various types of systems.

It is still another object of the present invention to enable, including in a test, a combination of the simulated and real sub systems, while enabling easy alternation between simulated and real sub-systems.

Other objects and advantages of the present invention will become apparent as the description proceeds.

SUMMARY OF THE INVENTION

The present invention relates to a method for alternately simulating sub-systems of a tested real system, comprising the steps of: (a) producing a sequence diagram defining the intercommunication of messages between the various sub-systems of the real system in terms of at least time, message name, issuing sub-system, and destination sub-system; (b) whenever there is a need to test one or more real sub-systems of the system, activating said sequence diagram, while eliminating those messages relating to existing sub-systems, and maintaining all those messages relating to missing sub-systems, said maintained messages being simulated messages for said missing sub-systems; (c) introducing in real time, and in appropriate messages format, said simulated messages on a bus leading to said real sub-systems, while further timely introducing real messages of existing real sub-systems over same bus; and (d) receiving by said sequence diagram those real messages of existing sub-systems, in order to synchronize the progression of the sequence diagram, and to satisfy conditions for issuing messages by the sequence diagram, when applicable.

Preferably, the method includes alternately replacing between corresponding real and simulated sub-systems.

Preferably, the issuing of at least some of the messages in the sequence diagram is conditional.

Preferably, the sequence diagram defines the intercommunication of messages between the various sub-systems of a full real system.

Preferably, the sequence diagram defines the intercommunication of messages between various sub-systems of a partial real system.

Preferably, the sequence diagram comprises a plurality of sub-sequences.

Preferably, the sequence diagram being divided into a plurality of sequences, each defining the intercommunication of messages between a specific sub-system and other sub-systems of a real system in terms of time, message name, issuing sub-system, and destination sub-system.

The invention also relates to a system for simulating one or more sub-systems of a tested system, which comprises: (a) a sequence diagram storage and engine unit containing a predefined sequence diagram defining the intercommunication of messages between the various sub-systems of a real system in terms of at least time, message name, issuing sub-system, and destination sub-system; (b) means for indicating to said sequence diagram storage and engine unit, those missing sub-systems, which have to be simulated; (c) means within said sequence diagram storage and engine unit for receiving activation signal for the sequence diagram, and for eliminating all those messages in the sequence diagram relating to non-missing sub-systems, while maintaining those messages relating to missing sub-systems; (d) one or more simulated sub-system units, each containing a domain of predefined output messages in appropriate format that can be issued by said simulated sub-system unit, and predefined input messages in appropriate format that can be received by said simulated sub-system unit, both said domains being essentially identical to those of the corresponding real sub-systems of the system; and (e) a real time engine for activating said sequence diagram, for receiving messages relating to missing sub-systems from one or more of said simulated sub-systems units, for introducing in real time said received messages on a bus leading to said real sub-systems, and for receiving messages issued by said real sub-systems and conveying them in real time to said simulated sub-system units.

Preferably, each real sub-system can be replaced by a simulated sub-system, by appropriately providing indication to said sequence diagram storage and engine unit.

Preferably the system enables alternately replacing between corresponding real sub-systems and simulated sub-system units.

Preferably, the issuing of at least some of the messages in the sequence diagram is conditional.

Preferably, the sequence diagram defines the intercommunication of messages between the various sub-systems of a full real system.

Preferably, the sequence diagram defines the intercommunication of messages between various sub-systems of a partial real system.

Preferably, the sequence diagram comprises a plurality of sub-sequences.

Preferably, the sequence diagram is divided into a plurality of sequences, each defining the intercommunication of messages between a specific sub-system and other sub-systems of a real system in terms of time, message name, issuing sub-system, and destination sub-system.

DETAILED DESCRIPTION OF PREFERRED EMBODIMENTS

Figure 1:
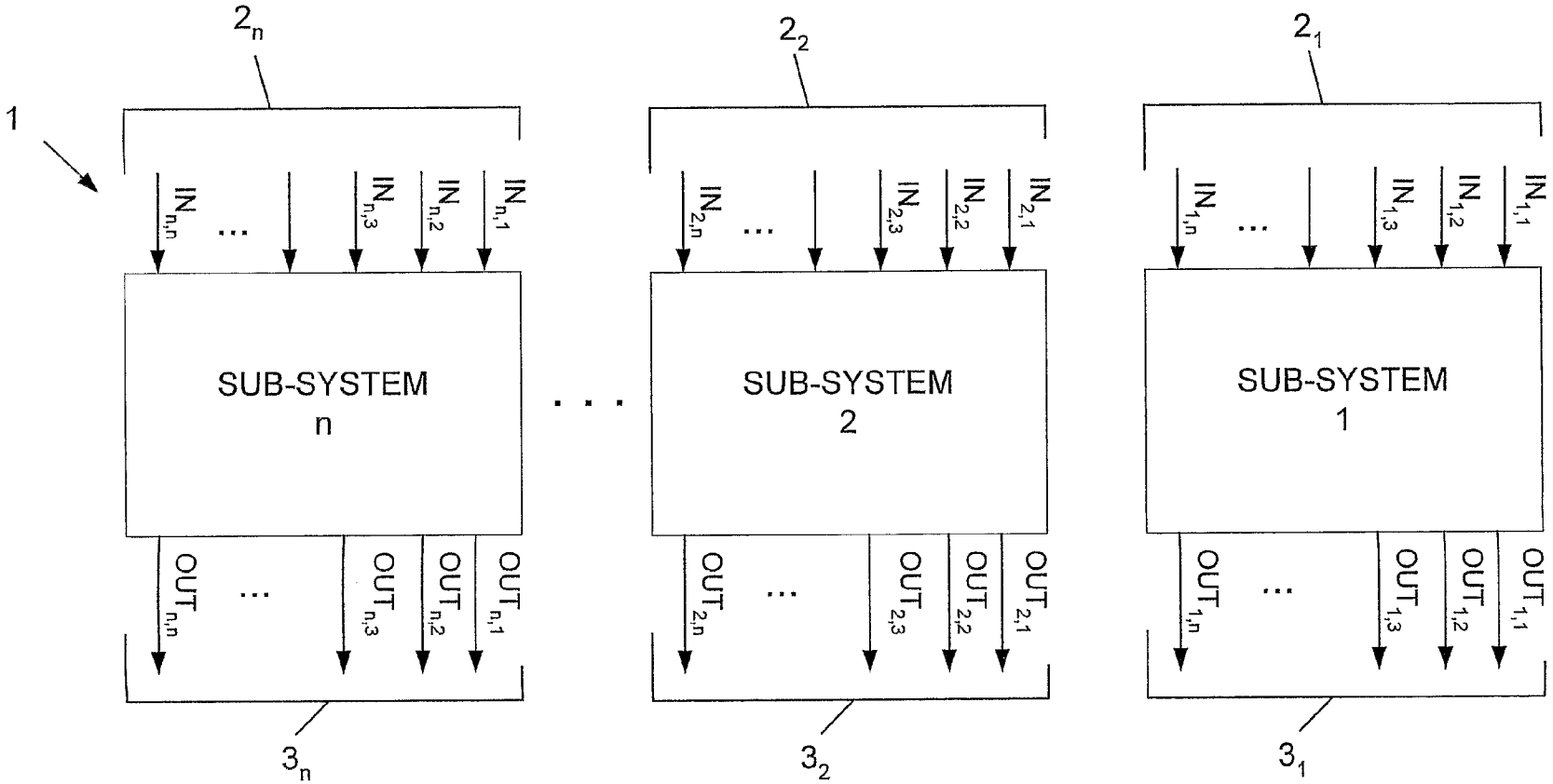
Fig. 1 PRIOR ART
FIG. 1 discloses a general input/output structure of plurality of sub-systems according to the prior art.

FIG. 1 generally illustrates the input/output structure of a typical real system comprising several sub-systems. The number of sub-systems within a system can, of course, vary. Each sub-system has its input domain of messages 2, and its output domain of messages 3. Of course, the sub-systems are somehow being connected one to the others, and there is some relation between specific input/s to some output messages, or between combinations of several input messages to an output message.

Of course, in reality the various sub-systems are somehow interconnected in a predefined manner to form the complete real system. By "interconnection" it is meant herein to wire or wireless communication, and to the types of messages that flow between the various sub-systems. However, when testing the complete system and when one or more of the sub-systems are missing, there is a need to provide substitution for the output messages of any missing sub-system. Therefore, the present invention discloses a generic method and system for providing a simulator, which can substitute for any missing sub-system of the system. Alternatively, when a missing real sub-system becomes available and needs to be tested, this real sub-system is connected to the system, and the simulator no longer simulates said previously missing sub-system.

Figure 2:
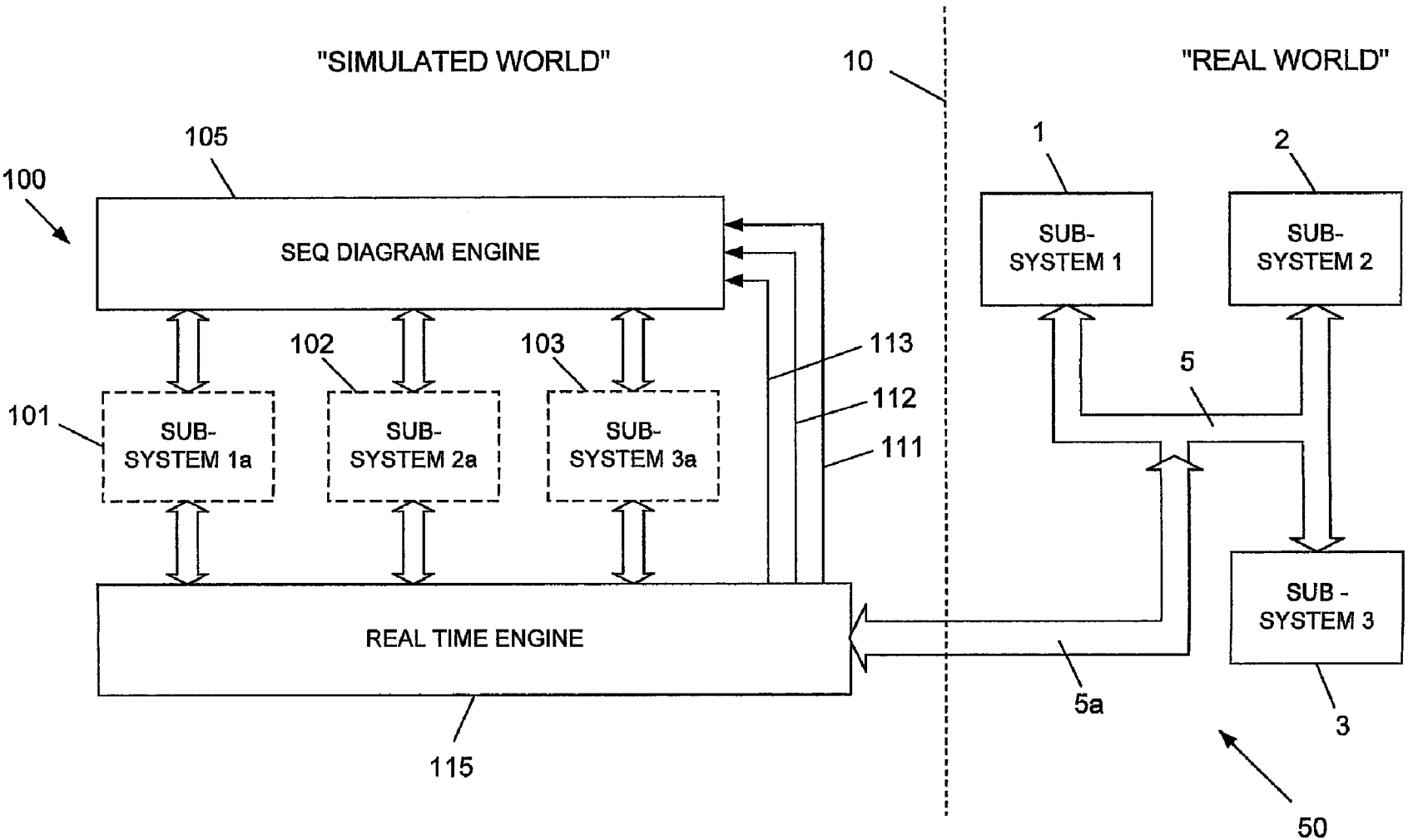
FIG. 2, is a block diagram generally illustrating the structure of a simulation-testing system according to the present invention.

The structure of the simulator of the present invention is generally illustrated in FIG. 2. The "real world" is illustrated at the right side of dotted line 10, and the "simulated world" is illustrated at the left side of dotted line 10. In the best case, when all the real sub-systems 1, 2, and 3 are available, there is essentially no need for the simulator 100 shown at the left side of dotted line 10, as all the sub-systems can communicate one with the others, in a normal manner by means of bus 5. However, when for any reason, one or more of the sub-systems 1, 2, or 3, becomes unavailable, and the rest of the system has to be tested, the simulator 100 substitutes, for each missing sub-system, one or more corresponding simulated sub-system units 101, 102, and 103. In that case, the testing of the rest of the real system 50 can be carried out as is necessary. The simulator 100 provides via bus 5*a* into bus 5 the substituted messages for the missing, now substituted sub-systems.

The structure of simulator 100 will now be described. At a first stage, the domain of all possible output messages are defined separately for each simulated sub-system unit 101, 102, and 103. Furthermore, a domain of all possible input messages that each unit can receive, is also defined respectively for each simulated sub-system unit, Said input and output domains of messages are stored correspondingly in said simulated sub-system units. At a next stage, a sequence diagram for the whole system is defined and stored in sequence diagram engine 105. The sequence diagram defines the sequence, times, specific messages and, optionally, conditions for issuing each message by sub-system units 101, 102, and 103, during the simulated activity.

As said, sequence diagrams are well known in the art, and they can be prepared using the language UML (versions 1 and 2 are presently available).

Figure 3:
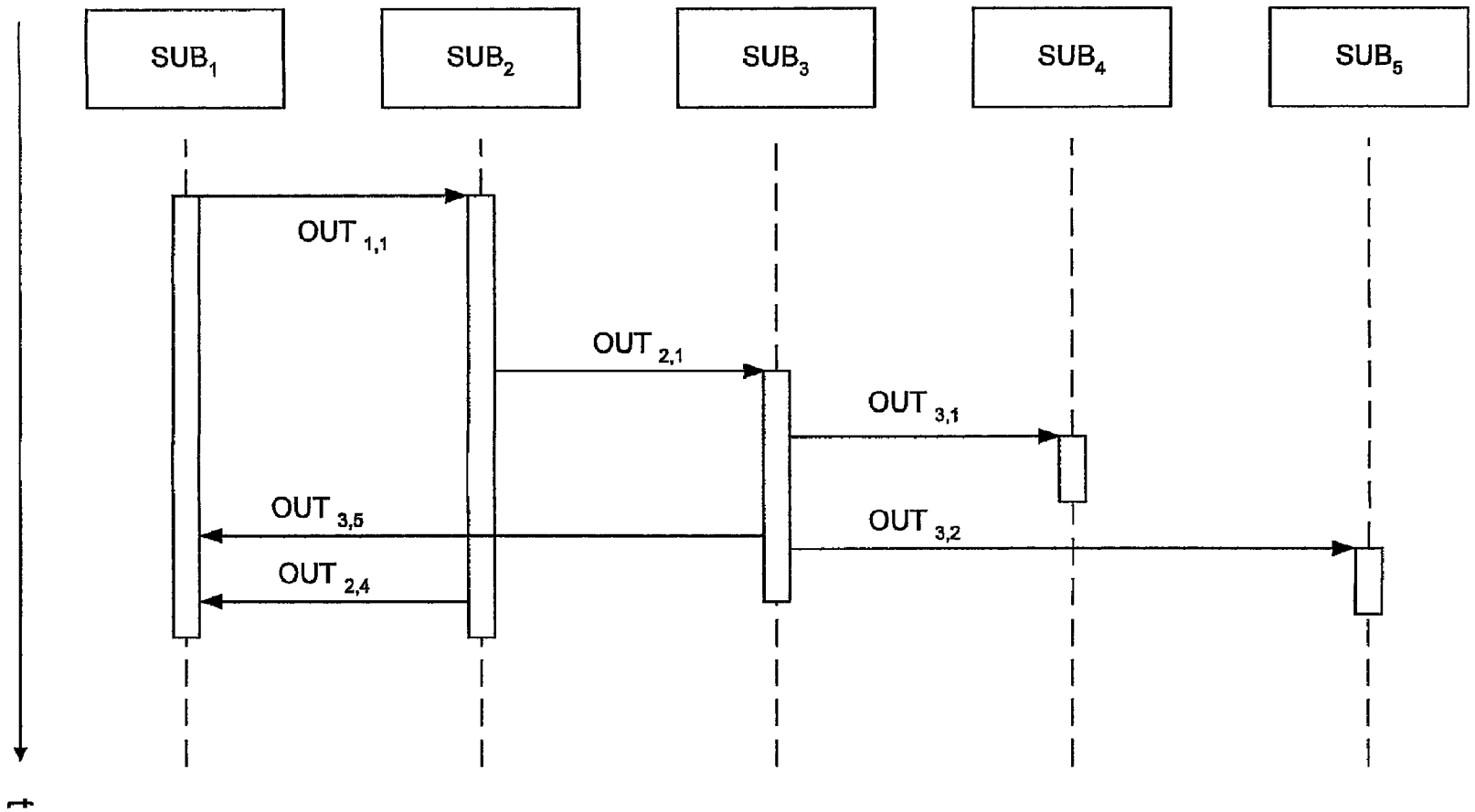
FIG. 3 generally illustrates a sequence diagram according to an embodiment of the invention.

An example for a sequence diagram for a simple system having five subsystems (indicated as $Sub_1$-$Sub_5$) is shown in FIG. 3. The vertical dimension of the sequence diagram represents time. The horizontal dimension represents the message exchange between the various sub-systems. The dotted line under each sub-system represents the lifeline of the sub-system (i.e., the duration in which the sub-system is in standby or active state), and the vertical boxes under the various subsystems represent durations in which the sub-systems are active. The messages themselves are symbolized by their corresponding name. For example, message $Out_{2,4}$ indicates an output message of type 4 which is issued by sub-system 2. In this case, message $Out_{2,4}$ is issued by sub-system 2, and is conveyed to sub-system 1. It should be noted that, optionally, the issuing of some of the messages may be conditioned. For example, message $Out_{3,1}$ may be designed to be issued by sub-system 3 only after a delay of 2 seconds from the receipt of message $Out_{2,1}$ at sub-system 3. Various types of other conditions may be applied. It should be noted that the sequence diagram generally comprises several, in some complicated cases many, sub-sequences, each of which may have the general form of the sequence of FIG. 3. The actual activation of the various sub-sequences may be conditional in terms of occurrence of events as defined.

Such sequence diagrams have been generally used by engineers in the art, either for only displaying the sequence, or for the purpose of providing a unified software simulation. Moreover, never in the prior art has it been proposed to enable using the sequence diagram of the full system to simulate alternately for missing and real sub-systems, as in the present invention.

Having the sequence diagram of the full system and the domains containing all the possible messages for each sub-system, the simulator is essentially ready for operation. With reference again to FIG. 2, when one or more of the real sub-systems 1, 2, or 3 is missing, the real time engine 115 provides corresponding indications 111, 112, or 113 indicating to the sequence diagrams storage and engine unit 105, which sub-system portions of the sequence diagram to maintain, and which to ignore. The activated portions of the sequence diagram are those relating to the one or more missing sub-systems, and those portions that are ignored, relate to existing real sub-systems that do not have to be simulated.

Then, when the sequence diagram is activated and run by the engine 105, the engine timely conveys messages of only the missing (and now simulated) sub-systems to the corresponding one or more simulated sub-system units 101, 102, or 103. Said one or more simulated sub-system units issue in real time from among their domain of output messages, corresponding simulated messages, which have an appropriate format for introduction on bus 5. Said simulated messages have the same format, and essentially same timing as would otherwise be issued by a missing real sub-system. The simulated messages are then introduced by real-time engine 115 over bus 5*a*, which in turn introduces the message on bus 5. In such a manner, the existing one or more real sub-systems in the "real world" receive simulated messages, having same format and timing, as would otherwise be conveyed to them by a real (now missing) sub-system. Therefore, in such a manner, the existing real sub-systems can be tested. Furthermore, as said, the issuance of some of the sequence diagram messages is conditional in terms of the occurrence, or receipt of one or more messages from a real sub-system 1, 2, or 3. Therefore, said real messages, as issued by real sub-systems 1, 2, or 3 and introduced on bus 5, are conveyed via bus 5*a* into the real time engine 115, which in turn conveys in real time each message to a corresponding simulated sub-system unit 101, 102, or 103, which in turn conveys said message to the sequence diagram engine 105, notifying it about the issuance of said real message by a real sub-system. In such a manner the sequence diagram within sequence diagram engine is synchronized about all messages issued in the "real world", and it can also satisfy all its conditions which depend on messages from real sub-systems in the "real world.

It should be noted that that the sequence diagram engine 105, when operated, indicates respectively to each simulated sub-system unit 101, 102, and 103, which message from its domain of messages to issue, and when to issue said message. Furthermore, the sequence diagram engine 105 indicates to each simulated sub-system unit 101, 102, and 103, and appropriate times to which real message to wait.

Later on, when, for example, one of the missing real sub-systems becomes available, and is introduced at the "real world" portion of the system, real time engine 115 updates the sequence diagram storage and engine unit 105 accordingly, by an updated corresponding message 111-113, and the simulator 100 operates in an updated form, ceasing simulation of the newly introduced sub-system.

Figure 4:
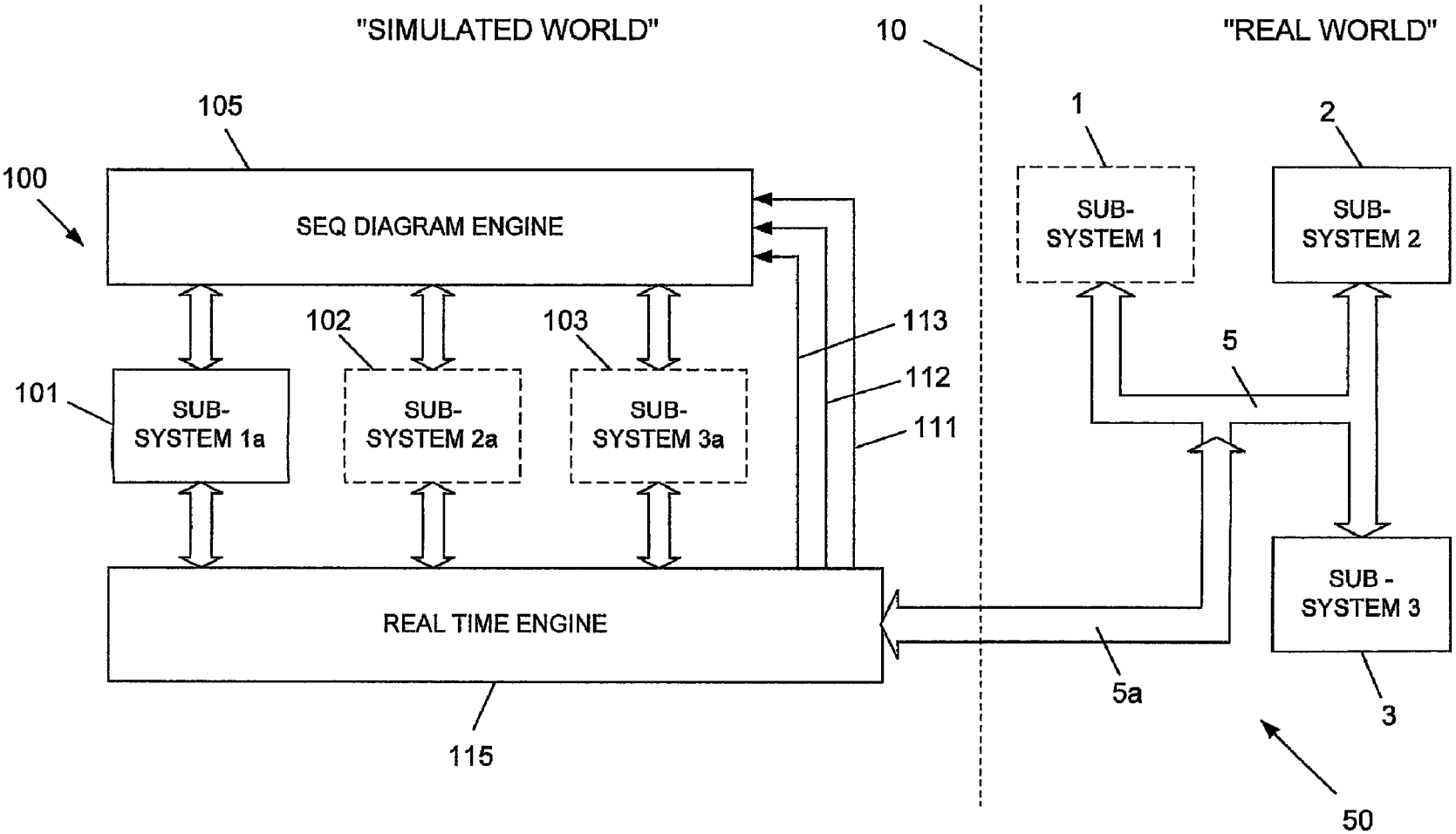
FIG. 4 illustrates a specific case in which subsystem 1 is simulated, while sub-system 2 and sub-system 3 are tested.

FIG. 4 illustrates an exemplary case in which real sub-system 1 is missing, while real sub-system 2 and real sub-system 3 are available, and have to be tested. In that case, the real time engine 115 issues indication 111 into sequence diagrams storage and engine unit 105 indicating it to activate the sequence diagram, while ignoring (or eliminating the appearance of) the messages within the sequence diagram relating to the existing sub-system 2, and sub-system 3. Then, the sequence diagram messages relating to the real sub-system 1 are conveyed into the simulated sub-system unit 101, which issues in real time corresponding messages in appropriate format, that are conveyed into real-time engine 115, which in turn introduces them into bus 5*a*, which in turn introduces them on bus 5, which in turn conveys them correspondingly into the tested real systems 2 and 3. Furthermore, real messages that are issued by the available real sub-systems 2 and 3, respectively, are conveyed via bus 5, bus 5*a*, the real time engine 115, and corresponding simulated subsystem units 102, or 103 respectively, into the sequence diagram engine 105, to synchronize it, and to satisfy conditional issuance of messages.

It should be noted that the sequence diagram essentially defines the behavior of the whole system, as it describes the sequence, timing, and specific messages that will be issued by its various sub-systems. Selection from the sequence diagram of only the messages relating to the missing sub-systems enables simulation of only said sub-system. Of course, there may be cases that several sub-systems have to be simulated simultaneously. In such a case, selection of more corresponding portions from the sequence diagram will be made. Therefore, the corresponding several missing sub-systems will be simultaneously simulated. It should be noted that FIGS. 2 and 4 includes 3 sub-systems only for the purpose of illustration. The system may include any number of sub-systems essentially in a same manner. Furthermore, it should be noted that the sequence diagram does not necessarily have to be unified and relate to the whole system as shown in FIGS. 3 and 5 discussed above, and it may be divided into several discreet sequence diagrams, each relating to one or several sub-systems.

EXAMPLE

Figure 5:
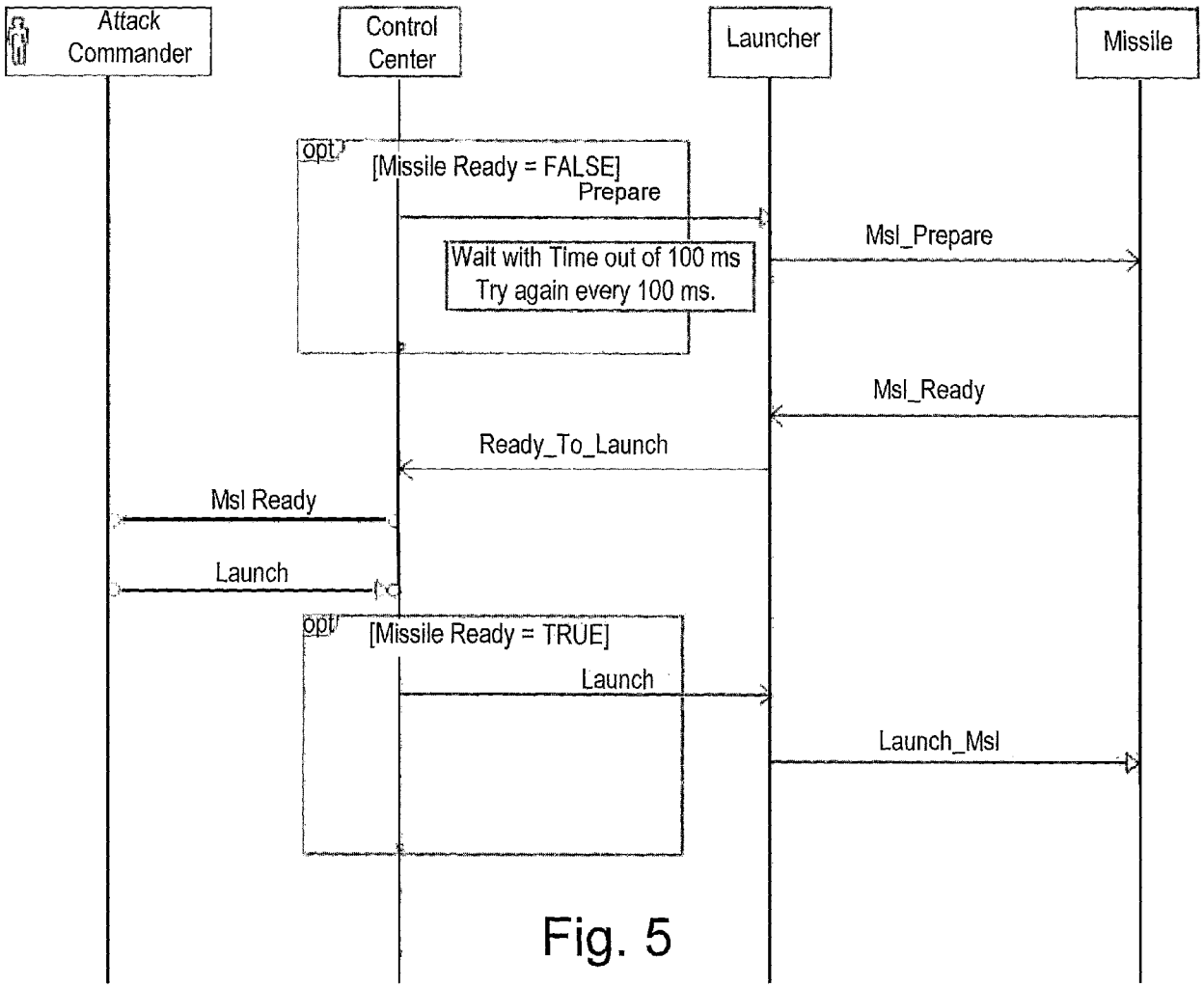
FIG. 5 provides an exemplary sequence diagram relating to a missile system.

FIG. 5 illustrates an exemplary simplified sequence diagram for a missile system, which can be used according to the present invention. The sequence diagram was produced using UML2 language. The missile system comprises one user (an Attack Commander) and three sub-systems, as follows: a Control Center, a Launcher, and a Missile. Each of the above sub-systems and even the user can be simulated, while testing the other real sub-systems. As said, only the messages of missing sub-systems are issued and thereafter conveyed to the "real world", while all the others messages relating to existing and tested sub-systems are eliminated. Now, assuming that the Control Center and Missile are real, while the Launcher is simulated, the operation is as follows: The operation of the system begins by issuing a "Prepare" message by the real Control Center sub-system to the simulated Launcher sub-system unit. This issuing of said message depends (i.e., conditioned) on a false status of the message "Missile Ready", and this status is checked every 100 ms. The simulated Launcher sub-system unit, which was previously set by the sequence diagram engine to wait for said message, and upon receipt of said message conveys a "Msl_Prepare" message to the real Missile sub-system. Receiving said message, the real Missile sub-system, which has been waiting for said message, begins preparation, and when ready, it issues a message "Msl_Ready" which is conveyed to the simulated Launcher sub-system unit. The Launcher sub-system unit, which was previously set by the sequence diagram engine to wait for the message "Msl_Ready" (from the real Missile), in turn issues and conveys a message "Ready_to_Launch" to the real Control Center, which in turn issues and conveys a message "Msl Ready" to the Attack Commander (the user). Then, the Attack Commander issues and conveys to the real Control Center a "Launch" message, which in turn issues a message "Launch" to the simulated Launcher sub-system unit (which was previously set by the sequence diagram to wait for this message). Upon receipt of said "Launch" message, the simulated Launcher sub-system unit issues a "Launch_Msl" message to the real Missile.

As said, according to the present invention, and having said sequence diagram, each one or more of the above sub-systems can alternatively be simulated or tested.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. Method for alternately simulating sub-systems of a tested real system, comprising the steps of:

a. producing a sequence diagram defining the intercommunication of messages between the various sub-systems of the real system in terms of at least time, message name, issuing sub-system, and destination sub-system;

b. upon testing one or more real sub-systems of the system, activating said sequence diagram, while eliminating those messages relating to existing sub-systems, and maintaining all those messages relating to missing sub-systems, said maintained messages being simulated messages for said missing sub-systems;

c. introducing in real time said simulated messages on a bus leading to said real sub-systems, while further timely introducing real messages of existing real sub-systems over same bus;

d. receiving by said sequence diagram those real messages of existing sub-systems, in order to synchronize the progression of the sequence diagram, and to satisfy conditions for issuing messages by the sequence diagram, when applicable; and wherein said sequence diagram is divided into a plurality of sequences, each defining the intercommunication of messages between a specific sub-system and other sub-systems of a real system in terms of time, message name, issuing sub-system and destination sub-system.

2. Method according to claim 1, which includes alternately replacing between corresponding real and simulated sub-systems.

3. Method according to claim 1, wherein the issuing of at least some of the messages in the sequence diagram is conditional.

4. Method according to claim 1, wherein the sequence diagram defines the intercommunication of messages between the various sub-systems of a real system.

5. Method according to claim 1, wherein the sequence diagram defines the intercommunication of messages between a selected portion of the various sub-systems that exist in a real system.

6. Method according to claim 1, wherein the sequence diagram comprises a plurality of sub-sequences.

7. System for simulating one or more sub-systems of a tested system, comprising:

a. a sequence diagram storage and engine unit containing a predefined sequence diagram defining the intercommunication of messages between the various sub-systems of a real system in terms of at least time, message name, issuing sub-system, and destination sub-system;

b. means for indicating to said sequence diagram storage and engine unit, those missing sub-systems, which have to be simulated;

c. means within said sequence diagram storage and engine unit for receiving activation signal for the sequence diagram, and for eliminating all those messages in the sequence diagram relating to non-missing sub-systems, while maintaining those messages relating to missing sub-systems;

d. one or more simulated sub-system units, each containing a domain of predefined output messages that can be issued by said simulated sub-system unit, and predefined input messages that can be received by said simulated sub-system unit, both said domains being essentially identical to those of the corresponding real sub-systems of the system;

e. a real time engine for activating said sequence diagram, for receiving messages relating to missing sub-systems from one or more of said simulated sub-systems units, for introducing in real time said received messages on a bus leading to said real sub-systems, and for receiving messages issued by said real sub-systems and conveying them in real time to said simulated sub-system units; and wherein said sequence diagram is divided into a plurality of sequences, each of the plurality of sequences defining the intercommunication of messages between a specific sub-system and other sub-systems of a real system in terms of time, message name, issuing sub-system and destination sub-system.

8. System according to claim 7, wherein each real sub-system can be replaced by a simulated sub-system, by appropriately providing indication to said sequence diagram storage and engine unit.

9. System according to claim 7, which includes alternately replacing between corresponding real sub-systems and simulated sub-system units.

10. System according to claim 7, wherein the issuing of at least some of the messages in the sequence diagram is conditional.

11. System according to claim 7, wherein the sequence diagram defines the intercommunication of messages between all the various sub-systems of a real system.

12. System according to claim 7, wherein the sequence diagram defines the intercommunication of messages between a selected portion of the various sub-systems that exist in a real system.

13. System according to claim 7, wherein the sequence diagram comprises a plurality of sub-sequences.

* * * * *